US007808472B2

(12) United States Patent
Park et al.

(10) Patent No.: US 7,808,472 B2
(45) Date of Patent: Oct. 5, 2010

(54) LIQUID CRYSTAL DISPLAY AND DRIVING METHOD THEREOF

(75) Inventors: Jong Jin Park, Anyang-si (KR); Sang Yeup Lee, Uiwang-si (KR); Seong Hun Jeong, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 986 days.

(21) Appl. No.: 11/602,643

(22) Filed: Nov. 21, 2006

(65) Prior Publication Data

US 2007/0279360 A1 Dec. 6, 2007

(30) Foreign Application Priority Data

Jun. 2, 2006 (KR) ..... 10-2006-0049819

(51) Int. Cl.
*G09G 3/36* (2006.01)

(52) U.S. Cl. ..... 345/100; 345/87; 345/98

(58) Field of Classification Search ..... 345/55, 345/84, 87, 90, 92, 98, 100; 349/19, 33, 349/37, 38, 39, 84, 139, 143
See application file for complete search history.

(56) References Cited

U.S. PATENT DOCUMENTS

| | | | | |
|---|---|---|---|---|
| 5,436,635 | A * | 7/1995 | Takahara et al. | 345/92 |
| 6,552,707 | B1 * | 4/2003 | Fujiyoshi | 345/98 |
| 6,731,365 | B2 * | 5/2004 | Lin et al. | 349/143 |
| 2001/0011981 | A1 * | 8/2001 | Yamamoto et al. | 345/87 |
| 2002/0008688 | A1 | 1/2002 | Yamamoto et al. | |
| 2003/0145876 | A1 | 8/2003 | Shih | |
| 2003/0189537 | A1 * | 10/2003 | Yun | 345/87 |
| 2005/0046620 | A1 | 3/2005 | Lee et al. | |
| 2005/0162363 | A1 * | 7/2005 | Kim | 345/92 |

FOREIGN PATENT DOCUMENTS

| | | |
|---|---|---|
| CN | 13659140 | 7/2002 |
| JP | 2003-248465 | 9/2003 |

OTHER PUBLICATIONS

European Search Report for corresponding European Patent Application Serial No. 06 02 3844.1, dated Oct. 8, 2007.
Office Action issued in corresponding Chinese Patent Application No. 2006101403645; issued Sep. 26, 2008.
Office Action issued in corresponding Japanese Patent Application No. 2006-304674; issued Mar. 8, 2010.

* cited by examiner

*Primary Examiner*—My-Chau T Tran
(74) *Attorney, Agent, or Firm*—Brinks Hofer Gilson & Lione

(57) ABSTRACT

A liquid crystal display device and a driving method thereof are provided. The liquid crystal display includes a data driver that is operative to supply data to the data lines. The data have the same polarity for the liquid crystal cells that are adjacent horizontally and opposite polarities for the liquid crystal cells that are adjacent vertically. A gate driver is operative to supply scan signals to the gate lines. The scan signals have different swing widths from each other in accordance with a polarity of the data. The switch devices include a plurality of first switch devices and a plurality of second switch devices. The first switch devices are connected to the $(n-1)^{th}$ (where n is a positive integer of not less than 2) gate line and the second switch devices are connected to the $n^{th}$ gate line.

2 Claims, 10 Drawing Sheets

(b) NEGATIVE RIVING(−)

Vg
Vd
Vcom
Vlc (a) POSITIVE DRIVING(+)

Vg
Vd
Vcom
Vlc

FIG. 4A

| | | | | | | | | | | | |
|---|---|---|---|---|---|---|---|---|---|---|---|
| + | + | + | + | + | + | + | + | + | + | + | + |
| − | − | − | − | − | − | − | − | − | − | − | − |
| + | + | + | + | + | + | + | + | + | + | + | + |
| − | − | − | − | − | − | − | − | − | − | − | − |
| + | + | + | + | + | + | + | + | + | + | + | + |
| − | − | − | − | − | − | − | − | − | − | − | − |
| + | + | + | + | + | + | + | + | + | + | + | + |
| − | − | − | − | − | − | − | − | − | − | − | − |
| + | + | + | + | + | + | + | + | + | + | + | + |
| − | − | − | − | − | − | − | − | − | − | − | − |
| + | + | + | + | + | + | + | + | + | + | + | + |
| − | − | − | − | − | − | − | − | − | − | − | − |

FIG. 4B

| | | | | | | | | | | | |
|---|---|---|---|---|---|---|---|---|---|---|---|
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |

LIQUID CRYSTAL DISPLAY AND DRIVING METHOD THEREOF

This application claims the benefit of the Korean Patent Application No. P06-0049819 filed on Jun. 2, 2006, which is hereby incorporated by reference.

BACKGROUND

1. Field

The present embodiments relate to a liquid crystal display device and a driving method thereof.

2. Related Art

Generally, a liquid crystal display device controls the light transmittance of liquid crystal by use of electric field, thereby displaying a picture. The liquid crystal display device includes a liquid crystal display panel where liquid crystal cells are arranged in a matrix shape and a drive circuit for driving the liquid crystal display panel.

In the liquid crystal display panel, as shown in FIG. 1, gate lines GL cross data lines DL, and a thin film transistor TFT for driving a liquid crystal cell is formed at each of the crossing parts of the gate lines GL and the data lines DL. The thin film transistor TFT supplies a data voltage Vd from the data line to a pixel electrode Ep of the liquid crystal cell Clc in response to a scan signal supplied through the gate line GL.

A gate electrode of the thin film transistor TFT is connected to the gate line GL. A source electrode of the thin film transistor TFT is connected to the data line DL. A drain electrode of the thin film transistor TFT is connected to the pixel electrode of the liquid crystal cell Clc. The liquid crystal cell Clc is charged with a potential difference between the data voltage Vd supplied to the pixel electrode Ep and the common voltage Vcom supplied to the common electrode Ec. The arrangement of liquid crystal molecules is changed by the electric field formed by the potential difference to control the amount of the transmitted light or to block the light.

The common electrode Ec is formed in the upper substrate and the lower substrate of the liquid crystal display panel in accordance with a method of applying the electric field to the liquid crystal cell Clc. A storage capacitor Cst for keeping a charge voltage of the liquid crystal cell Clc is formed between the common electrode Ec and the pixel electrode Ep.

The liquid crystal display panel is driven by an inversion method where the polarity of the data voltage Vd is inverted for each fixed period in order to prevent the deterioration of the liquid crystal cell Clc. The inversion method includes a dot inversion method, a line inversion method, a column inversion method, and a frame inversion method.

FIG. 2 represents drive voltages supplied to the liquid crystal display panel which is driven by a line inversion method. In FIG. 2, 'Vg' is a scan signal supplied to the gate line GL, 'Vd' is a data voltage supplied to the data line DL, 'Vcom' is a common voltage supplied to the common electrode Ec of the liquid crystal cells Clc, and 'Vlc' is a data voltage with which the liquid crystal cell Clc is charged or discharged.

Referring to FIG. 2, in the driving of the line inversion method, the common voltage Vcom is supplied as a fixed DC voltage. The data voltage Vd has its polarity inverted on the basis of the common voltage Vcom for each horizontal period 1H. If a normal black mode is assumed, the transmittance of the light transmitted through the liquid crystal layer is increased as the potential difference between the data voltage Vd and the common voltage Vcom is increased. The transmittance of the light transmitted through the liquid crystal layer is decreased as the potential difference of the data voltage Vd and the common voltage Vcom is reduced.

The scan signal Vg swings between a gate high voltage Vgh which is set as a voltage for turning on the thin film transistor TFT and a gate low voltage Vgl which is set as a voltage for turning off the thin film transistor TFT. The liquid crystal cell Clc is charged with the data voltage Vd supplied as a gamma voltage and maintains the charged voltage for a fixed time for a scan period while the scan signal Vg maintains the gate high voltage Vgh.

Alternatively, the voltage charged in the liquid crystal cell Clc and the storage capacitor Cst for the scan period, when the thin film transistor TFT maintains a turn-on state, should last after the thin film transistor TFT is changed to a turn-off state, but a charge voltage of the liquid crystal cell Clc is shifted by ΔVp because of a parasitic capacitor Cgd between the gate electrode and the drain electrode of the thin film transistor TFT. The ΔVp is a kickback voltage or feed-through voltage. The feed-through voltage ΔVp is generally calculated by a formula shown in Mathematical Formula 1 below.

$$\Delta Vp=(Cgd\times\Delta Vg)/(Cgd+Clc+Cst) \quad \text{[Mathematical Formula 1]}$$

Herein, 'ΔVp' is a feed-through voltage. 'Cgd' is a parasitic capacitance between the gate electrode and the drain electrode of the thin film transistor TFT. 'Clc' is a capacitance which is equivalently formed in the liquid crystal cell Clc. 'Cst' is a capacitance of a storage capacitor Cst. 'ΔVg' is a difference voltage between the gate high voltage Vgh and the gate low voltage Vgl.

The liquid crystal cell Clc is charged with a voltage which is lower by ΔVp than the data voltage Vd corresponding to the video data due to the feed-through voltage ΔVp, i.e., the liquid crystal cell Clc is charged with a voltage having a potential difference lower by ΔVp than the data voltage Vd in relation to the common voltage Vcom when driven in a positive (+) polarity. The liquid crystal cell Clc is charged with a voltage having a potential difference higher by ΔVp than the data voltage Vd in relation to the common voltage Vcom when driven in a negative (−) polarity. Accordingly, a flicker or residual image appears in a screen of the liquid crystal display panel due to a voltage offset in relation to the common voltage. The common voltage Vcom is adjusted by the voltage offset caused by the feed-through voltage ΔVp in the related art.

In relation to the positive (+) and negative (−) data voltages Vd which express the same gray level, a difference Vgd between the data voltage Vd and the gate high voltage Vgh when driven in the positive (+) polarity is different from a difference Vgd between the data voltage Vd and the gate high voltage Vgh when driven in the negative (−) polarity. The charge amount charged in the parasitic capacitor Cgd between the gate electrode and the drain electrode of the thin film transistor TFT is different when driven in the positive (+) polarity and when driven in the negative (−) polarity. The feed-through voltage ΔVp when driven in the positive (+) polarity becomes different from the feed-through voltage ΔVp when driven in the negative (−) polarity.

For example, the liquid crystal display panel is driven with a scan signal which swings between the gate low voltage Vgl of −5V and the gate high voltage Vgh of 25V, a common voltage of 7V, and a data voltage Vd of 14V which swings between 0V and 14V. In this example, the difference Vgd of the gate high voltage Vgh and the data voltage Vd is 11V when driven in the positive (+) polarity, but the difference Vgd of the gate high voltage Vgh and the data voltage Vd is 25V when driven in the negative (−) polarity. In this example, 14V and 0V represents the white gray level in the positive (+)

driving and in the negative (−) driving, respectively. Accordingly, a simulation of the feed-through voltage ΔVp, the feed-through voltage ΔVp in the positive (+) driving is 1.121V, but the feed-through voltage ΔVp in the negative (−) driving is 1.531V.

For example, there is a difference of about 400 mV between the feed-through voltage ΔVp in the positive (+) driving and the feed-through voltage ΔVp in the negative (−) driving. In case the feed-through voltage ΔVp in the positive (+) driving is different from the feed-through voltage ΔVp in the negative (−) driving, the flickers and residual images become worse as the difference is increased. This problem is even further increased when being driven by a line inversion method rather than by a dot inversion method, among the inversion methods which designates a positive and negative inversion cycle.

SUMMARY

The present embodiments may obviate one or more of the limitations of the related art. For example, in one embodiment a liquid crystal display device is adaptive for improving display quality by reducing the difference between a feed-through voltage when driven in a positive polarity and a feed-through voltage when driven in a negative polarity.

In another exemplary embodiment, a liquid crystal display device is adaptive for improving display quality by changing an arrangement structure of a pixel to supply data, of which the polarities are different from each other, to liquid crystal cells which are adjacent horizontally and vertically.

In one embodiment, a liquid crystal display device includes a plurality of data lines and a plurality of gate lines which cross the data lines. A plurality of liquid crystal cells are formed in pixel areas which are defined by the crossing of the data lines and the gate lines. A plurality of switch devices are disposed between the data lines and the gate lines. A data driver supplies data to the data lines. The data have the same polarity for the liquid crystal cells that are adjacent horizontally and opposite polarities for the liquid crystal cells that are adjacent vertically. A gate driver supplies scan signals to the gate lines. The scan signals have different swing widths from each other in accordance with a polarity of the data. The switch devices includes a plurality of first switch devices for driving a first liquid crystal cell and a plurality of second switch devices for driving a second liquid crystal cell. The first switch device is connected to the $(n-1)^{th}$ (where, n is a positive integer of not less than 2) gate line and the second switch device is connected to the $n^{th}$ gate line.

In one embodiment, the scan signal includes a first scan signal of a first swing width corresponding to the positive data. A second scan signal of a second swing width corresponds to the negative data, and the second swing width is narrower than the first swing width.

In one embodiment, the first scan signal has a first swing width between a first gate high voltage of not less than a threshold voltage of the switch device and a gate low voltage of less than the threshold voltage of the switch device. The second scan signal has a second swing width between the gate low voltage and a second gate high voltage. The second gate high voltage is a voltage between a threshold voltage of the switch device and the first gate high voltage.

In one embodiment, the gate drive circuit includes a shift register which generates a shift pulse and sequentially shifts the shift pulse by the unit of the gate line; and a level shifter which adjusts a swing width of the shift pulse to any one of the first swing width and the second swing width in accordance with the polarity of the data signal, and supplies to the gate lines.

In another embodiment, a driving method includes generating data, which have the same polarity for the liquid crystal cells that are adjacent horizontally and opposite polarities for the liquid crystal cells that are adjacent vertically, to supply to the data lines; and supplying scan signals, which have different swing widths from each other in accordance with a polarity of the data, to the gate lines.

In another embodiment of the driving method, the liquid crystal display device has a plurality of data lines, a plurality of gate lines which cross the data lines, a plurality of liquid crystal cells formed in pixel areas which are defined by the crossing of the data lines and the gate lines, a plurality of first switch devices disposed between the data lines and the gate lines for driving a first liquid crystal cell, and a plurality of second switch devices for driving a second liquid crystal cell which is horizontally adjacent to the first liquid crystal cell, and where the first switch device is connected to the $(n-1)^{th}$ (n is a positive integer of not less than 2) gate line and the second switch device is connected to the $n^{th}$ gate line according to another aspect of the present invention In the driving method, the scan signal includes a first scan signal of a first swing width corresponding to the positive data and a second scan signal of a second swing width corresponding to the negative data, and the second swing width is narrower than the first swing width.

BRIEF DESCRIPTION OF THE DRAWINGS

FIG. 4A is a diagram representing a polarity of data supplied to a liquid crystal display panel according to a line inversion method;

FIG. 4B is a diagram for explaining that the polarity of the data revealed in a liquid crystal display panel is substantially a dot inversion type;

DETAILED DESCRIPTION

Figure 1:
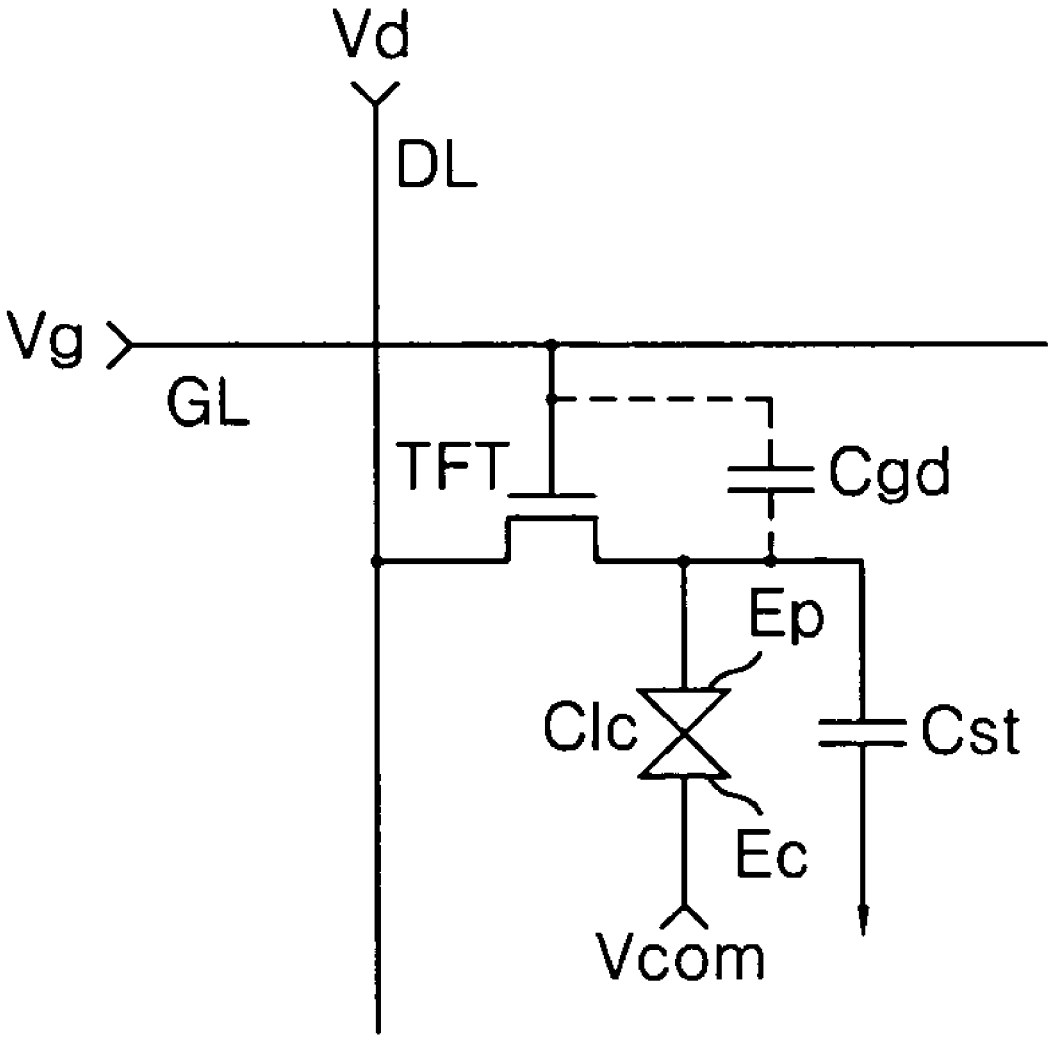
FIG. 1 RELATED ART
FIG. 1 is a diagram representing a pixel cell included in a liquid crystal display panel of the related art.
Figure 2:
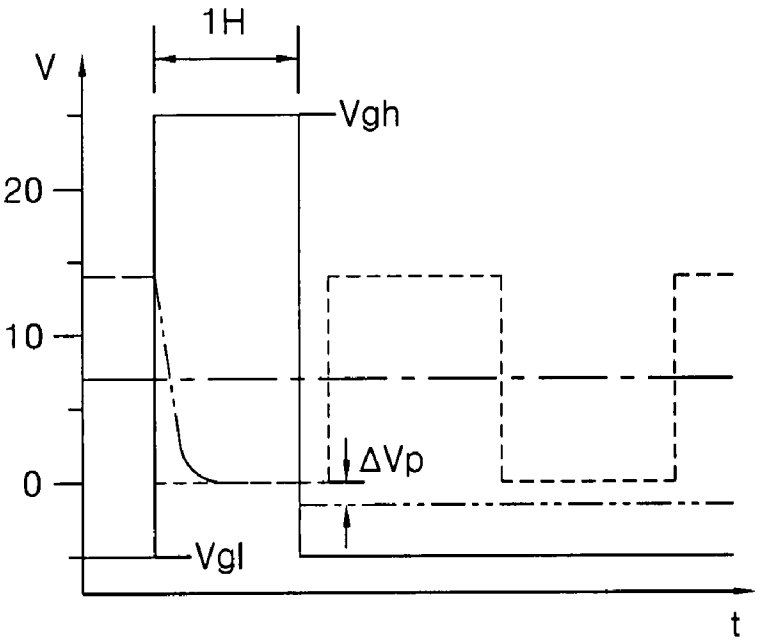
FIG. 2 RELATED ART
FIG. 2 is a diagram representing drive voltages for the pixel cell of FIG. 1.
Figure 2:
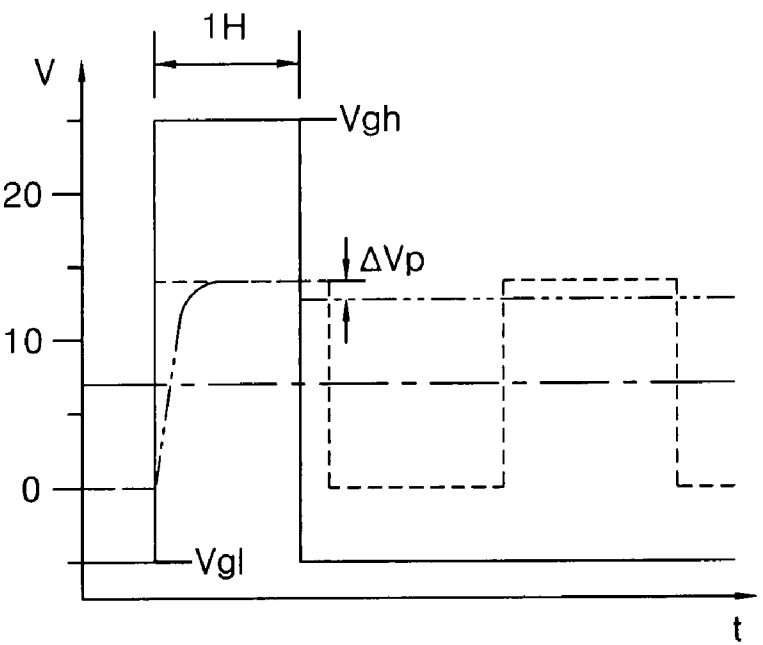
FIG. 2 RELATED ART
Figure 3:
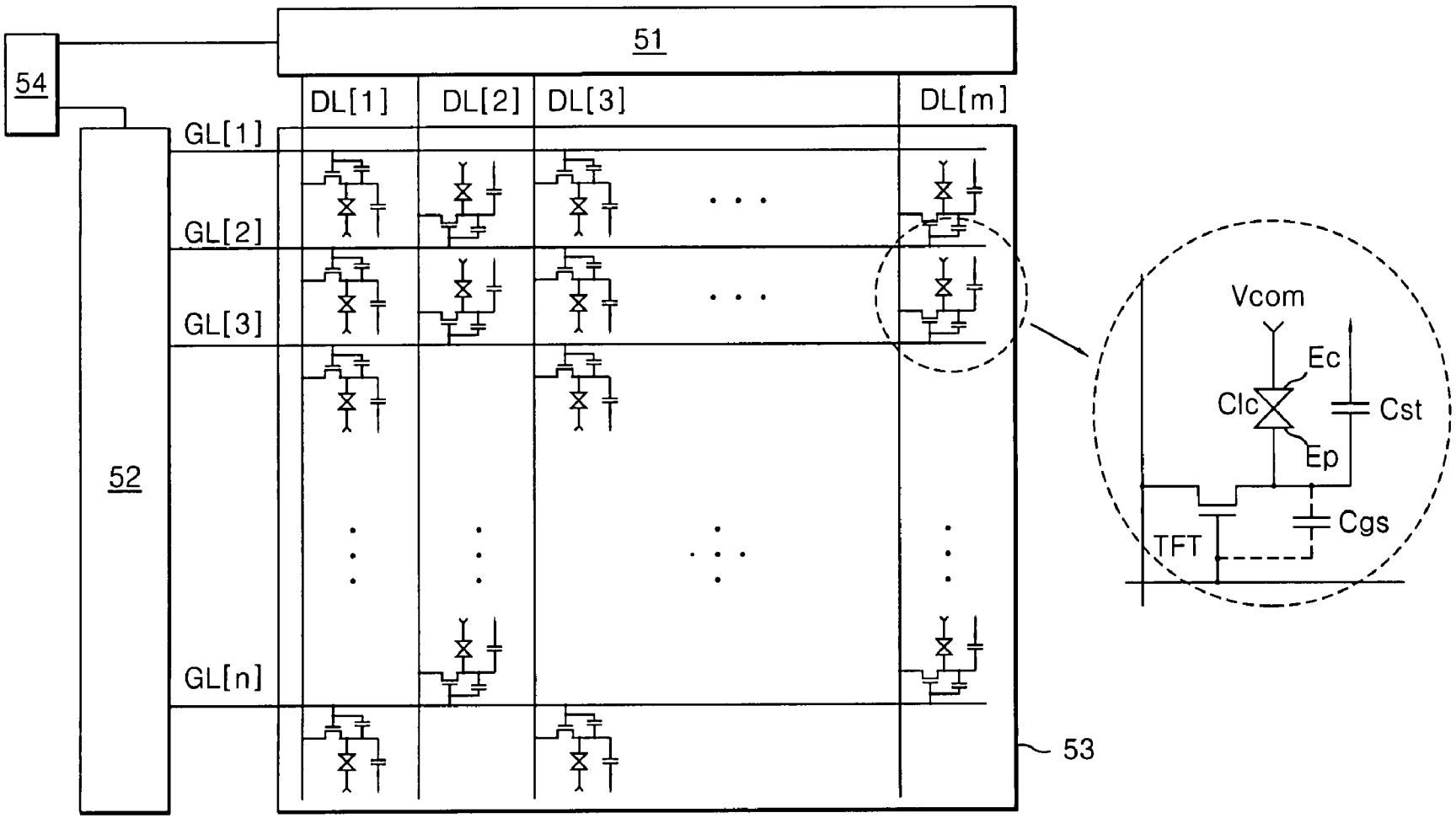
FIG. 3 is a diagram representing a liquid crystal display device according to one embodiment.
Figure 5:
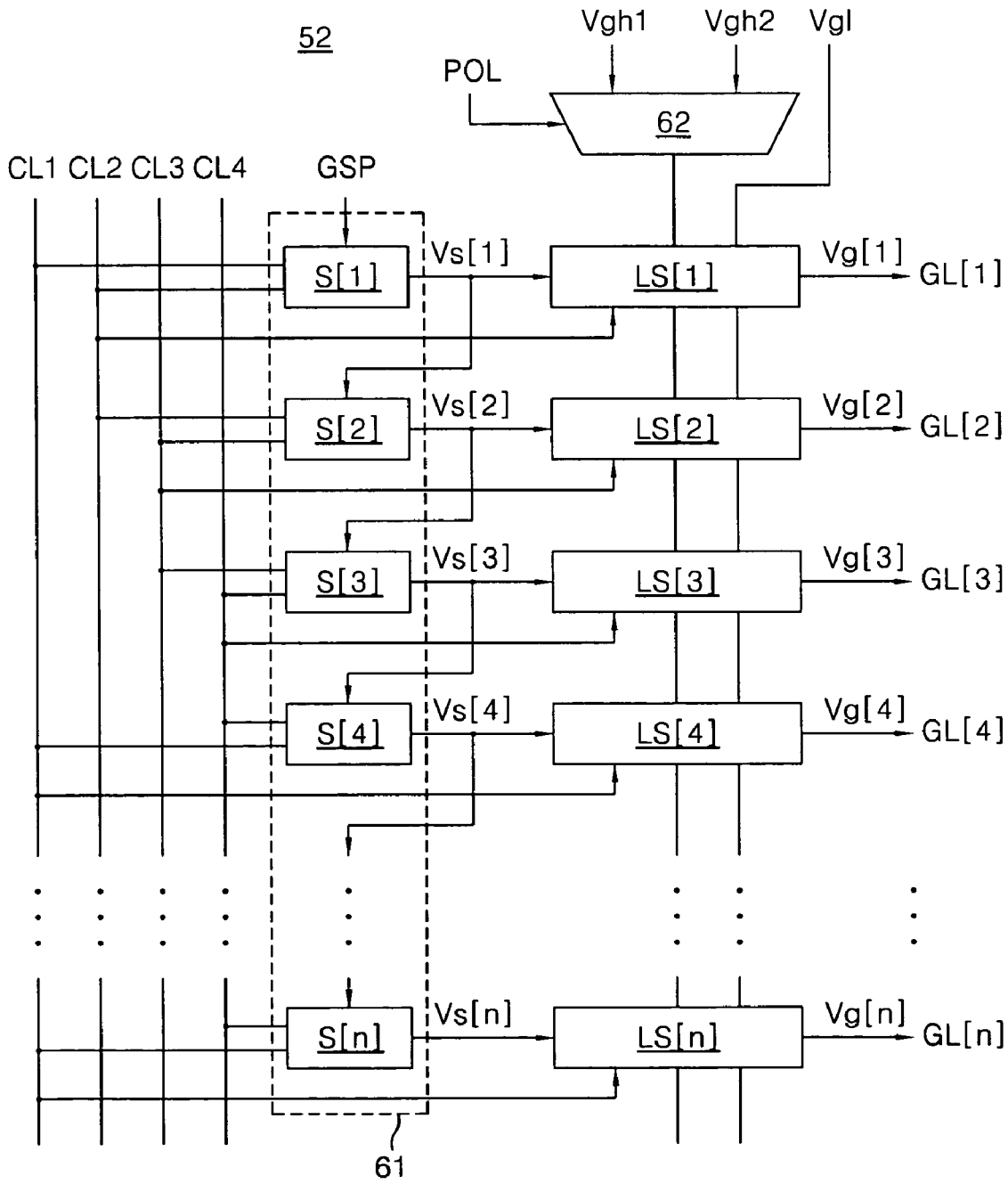
FIG. 5 is a diagram representing a detail configuration of a gate driver shown in FIG. 3.

Exemplary embodiments will be illustrated with reference to FIGS. 3 to 8B. FIG. 3 is a diagram representing a liquid crystal display device. FIG. 4A is a diagram representing a polarity of data supplied to a liquid crystal display panel by a line inversion method. FIG. 4B is a diagram for explaining that the polarity of the data realized in a liquid crystal display panel is substantially a dot inversion type. FIG. 5 is a diagram representing a detail configuration of a gate drive circuit shown in FIG. 3.

In one embodiment, as shown in FIG. 3, a liquid crystal display device includes a liquid crystal display panel where a plurality of gate lines GL1 to GLn (n is a positive integer)

cross a plurality of data lines DL1 to DLm (m is a positive integer) and which have liquid crystal cells Clc that are formed in pixel areas defined by the crossing thereof. A thin film transistor TFT is formed at each crossing part of the gate line GL1 to GLn and the data line DL1 to DLm for driving a liquid crystal cell Clc. A data drive circuit 51 for supplying a video signal to the data lines DL1 to DLm. A gate drive circuit 52 for supplying a scan signal to the gate lines GL1 to GLn. A timing controller 54 controls the data drive circuit 51 and the gate drive circuit 52.

In one embodiment, the liquid crystal display panel 53 has a structure where the upper substrate is bonded with the lower substrate. The gate lines GL1 to GLn and the data lines DL1 to DLm are formed to cross each other in the lower substrate of the liquid crystal display panel 53. The thin film transistor TFT formed at each of the crossing parts of the gate lines GL1 to GLn and the data lines DL1 to DLm supplies a data voltage Vd from the $j^{th}$ data line DL[j] (but, $1 \leqq j \leqq m$) to the pixel electrode Eo of the liquid crystal cell Clc in response to the scan signal Vg[k] from the $k^{th}$ gate line GL[k] (but, $1 \leqq k \leqq n$).

In one embodiment, the thin film transistors TFT include a plurality of first thin film transistors which drive first liquid crystal cells and a plurality of second thin film transistors which drive second liquid crystal cells that are horizontally adjacent to the first liquid crystal cells and which are disposed to alternate the first thin film transistors.

Herein, the first thin film transistor is connected to the $(n-1)^{th}$ (n is a positive integer of not less than 2) gate line and the second thin film transistor is connected to the $n^{th}$ gate line, thus a pixel arrangement thereof is made in a zigzag shape. The polarity of the data revealed in the liquid crystal display panel 53 is substantially a dot inversion type, as shown in FIG. 4B. The data are supplied to the liquid crystal display panel 53 according to the line inversion method, as shown in FIG. 4A.

In one exemplary embodiment, cross-talk and a residual image are eliminated and device reliability is secured, for example, by using the dot inversion driving and controlling the level of the gate high voltage Vgh to be different in accordance with the polarity of the data which are to be explained below.

In one embodiment, the gate electrodes of the thin film transistors TFT are connected to the gate lines GL1 to GLn, drain electrodes are connected to the data lines DL1 to DLn, and source electrodes are connected to the pixel electrodes Ep of the liquid crystal cells Clc. The liquid crystal cell Clc is charged with a potential difference between the data voltage Vd supplied to the pixel electrode Ep and the common voltage Vcom supplied to the common electrode Ec. The arrangement of the liquid crystal molecules is changed by the electric field formed by the potential difference to control the amount of the transmitted light.

The common electrode Ec is formed in the upper substrate or the lower substrate in accordance with a method of applying the electric field to the liquid crystal cell Clc. A storage capacitor Cst that maintains a charge voltage of the liquid crystal cell Clc is formed between the pixel electrode Ep and the common electrode Ec of the liquid crystal cell Clc. The storage capacitor Cst is formed between the pre-stage gate line GL (k−1) and the pixel electrode Ep of the liquid crystal cell Clc. For example, a color filter for realizing color and a black matrix for reducing light interference between adjacent pixels are formed in the upper substrate of the liquid crystal display panel 53. In one embodiment, additional suitable elements may be formed in the upper substrate of the liquid crystal display panel. Further, polarizers of which the light axes are at right angles to each other are adhered to the upper substrate and the lower substrate respectively, and an alignment film for setting a pre-tilt angle of the liquid crystal is formed in the inner surface of the substrates.

The timing controller 54 receives, for example, a digital video data RGB, and/or vertical/horizontal synchronization signals, and generates a gate control signal GDC that controls the gate drive circuit 52 and a data control signal DDC that controls the data drive circuit 51. The timing controller 54 re-aligns the digital video data in accordance with the clock signal to supply to the data drive circuit 51. The gate control signal GDC includes, for example, a gate start pulse GSP, a gate shift clock GSC, a gate output signal GOE. The data control signal DDC includes, for example, a source start pulse SSP, a source shift clock SSC, a source output signal SOE, a polarity control signal POL.

In one embodiment, the data drive circuit 51 converts the digital video data from the timing controller 54 into an analog gamma compensation voltage, i.e., a data voltage Vd, to supply to the data lines DL1 to DLm. The data drive circuit 51 includes a shift register for sampling the clock signal; a register for temporally storing the digital video data; a latch for storing the data for each line in response to the clock signal from the shift register and for outputting the stored data of the one line portion at the same time; a digital/analog converter for selecting a positive/negative gamma voltage in correspondence to the digital data value from the latch; a multiplexer for selecting the data line DL[j] to which the analog data converted by the positive/negative gamma voltage are supplied; and an output buffer connected between the multiplexer and the data line DL[j].

In one embodiment, the gate drive circuit 52 sequentially supplies the scan signal Vgl to Vgn, which selects the horizontal line of the liquid crystal display panel to which the data voltage is supplied, to the gate lines GL1 to GLn. The gate drive circuit 52, as shown in FIG. 5, includes a shift register 61 for sequentially shifting the gate start pulse GSP to generate the shift output signal Vs1 to Vsn; level shifters LS1 to LSn which convert the shift output signal Vs1 to Vsn from the shift register 61 into the scan signal Vgl to Vgn of which the voltage level is suitable for driving the thin film transistor and which supplies to the gate lines GL1 to GLn; and a voltage selector 62 for supplying a reference voltage required for converting the voltage level of the level shifter LS1 to LSn.

In one embodiment, the shift register 61 includes a plurality of stages which are connected in cascade. Each of the stages S1 to Sn receives the gate start pulse GSP or the shift output signal Vs1 to Vsn of the pre-stage S1 to Sn−1 as an input signal which is to be shifted, and outputs the shift output signal Vs1 to Vsn which is shifted by one clock, i.e., one horizontal period. For example, the gate start pulse GSP is supplied to the first stage S1 as the input signal which is to be shifted, and the shift output signal Vs1 to Vs[n−1 of the pre-stage S1 to S[n−1] is supplied to the second to $n^{th}$ stage S2 to Sn as the input signal which is to be shifted. The input terminal of the input signal, which is to be shifted, of the $k^{th}$ stage Sk except the first stage S1 is connected to the output terminal of the shift output signal Vs[k−1] of the $(k-1)^{th}$ stage S[k−1].

In another embodiment, each of the level shifters LS1 to LSn converts the shift output signal Vs1 to Vsn which is outputted from the stage S1 to Sn of the shift register 61 into the scan signal Vgl to Vgn which swings between the gate low voltage Vgl and any one of the first and second gate high voltages Vgh1, Vgh2 that are selected by a voltage selector 62, and supplies to the gate lines GL1 to GLn. The first and second gate high voltages Vgh1, Vgh2 are a voltage of not less than a threshold voltage of the thin film transistors TFT, i.e., a gate-on voltage, and the gate low voltage vgl is a voltage of less than a threshold voltage of the TFT's, i.e., a gate-off voltage. For example, the gate low voltage Vgl is supplied from an external voltage source.

In one embodiment, the voltage selector 62 receives the first and second gate high voltages Vgh1, Vgh2 from an external voltage source and selects any one of the first gate high voltage Vgh1 or the second gate high voltage Vgh2 in accordance with the polarity signal POL from the timing controller 51 to supply to the level shifter LS1 to LSn. The first gate high voltage Vgh1 and the second gate high voltage Vgh2 have different voltage levels from each other. Assuming that the first gate high voltage Vgh1 has a higher voltage level than the second gate high voltage Vgh2, the voltage selector 62 selects the first gate high voltage Vgh1 in response to the positive polarity signal POL and the second gate high voltage Vgh2 in response to the negative polarity signal POL.

TABLE 1 below is an exemplary simulation result of the feed-through voltage ΔVp by fixing the voltage level of the first gate high voltage Vgh1 and changing the voltage level of the second gate high voltage Vgh2. Referring to TABLE 1, the difference of the feed-through voltage ΔVp between upon the positive (+) driving and upon the negative (−) driving is 410 mV in a case where the first and second gate high voltages Vgh1, Vgh2 are identically set to be 25V. The difference of the feed-through voltage ΔVp between upon the positive (+) driving and upon the negative (−) driving is 6 mV in a case where the first gate high voltage Vgh1 is set to be 25V and the second gate high voltage Vgh2 is set to be 17.7V. Accordingly, the difference of the feed-through voltage ΔVp is reduced.

In one embodiment, the gate-on voltage upon the positive (+) driving is different from the gate-on voltage upon the negative (−) driving, i.e., the gate-on voltage upon the negative (−) driving is set to be lower than the gate-on voltage upon the positive (+) driving. Accordingly, the feed-through voltage ΔVp difference between upon the positive (+) driving and upon the negative (−) driving is reduced. Alternatively, the liquid crystal display device has a voltage level which is required for driving and which is different by kinds and by sizes, accordingly the second gate high voltage Vgh2 is set to be a value which is optimized experimentally to be suitable for the subject.

TABLE 1

| Polarity | Vg[k] | | | Vgd | | Difference between Δ Vp upon positive (+) driving and Δ Vp upon |
|---|---|---|---|---|---|---|
| signal (POL) | Vgl | Vgh | Vd | (Vgh − Vd) | Δ Vp | negative (−) driving |
| Positive (+) | −5 V | 25 V | 14 V | 11 V | 1.121 V | — |
| Negative (−) | −5 V | 25 V | 0 V | 25 V | 1.531 V | 410 mV |
| | −5 V | 22 V | 0 V | 22 V | 1.3697 V | 248 mV |
| | −5 V | 20 V | 0 V | 20 V | 1.2525 V | 131 mV |
| | −5 V | 18 V | 0 V | 18 V | 1.1443 V | 23 mV |
| | −5 V | 17.7 V | 0 V | 17.7 V | 1.1275 V | 6 mV |

Figure 6:
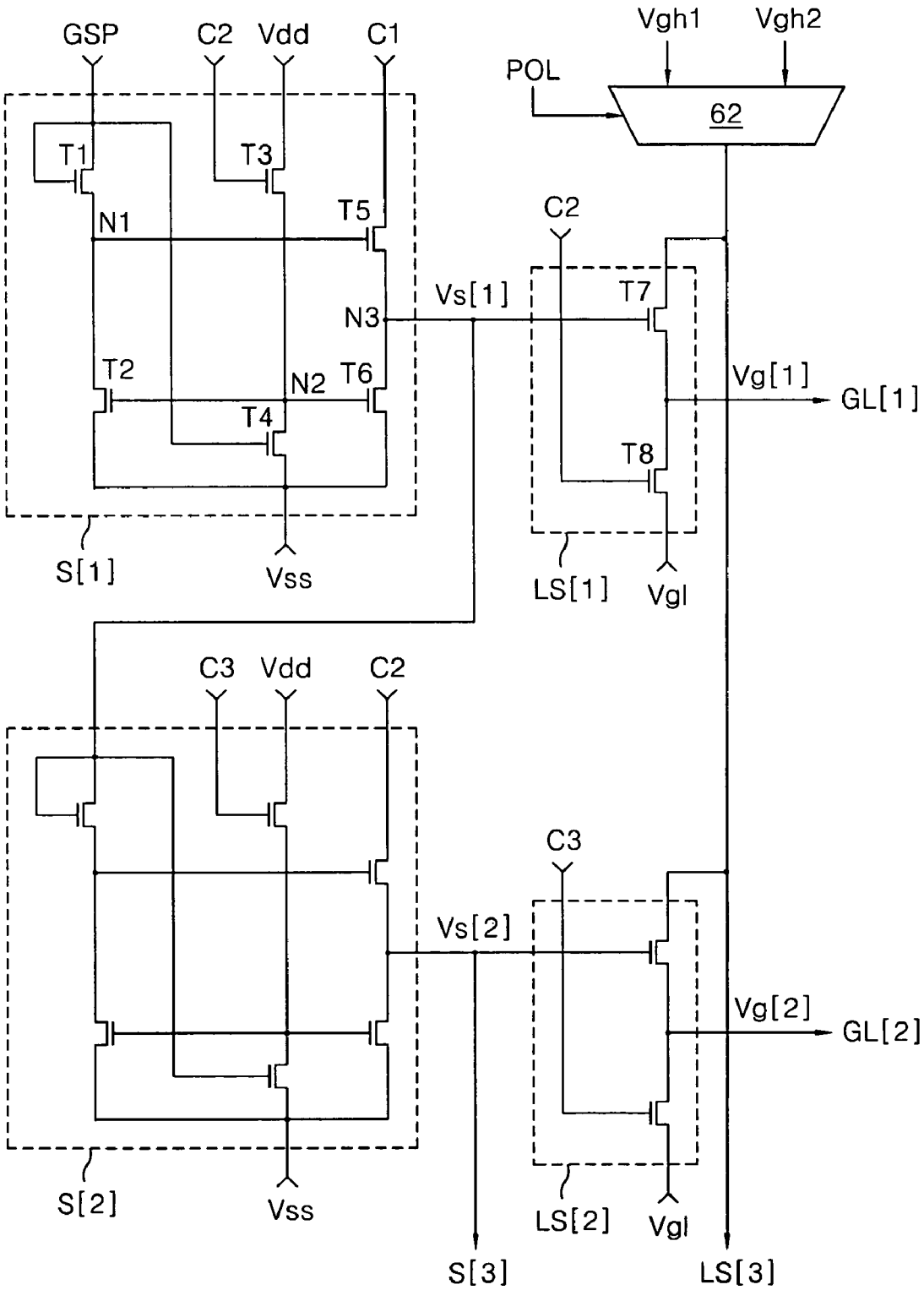
FIG. 6 is a diagram representing a circuit configuration of first and second level shifters and first and second stages of a shift register in a gate drive circuit shown in FIG. 5.
Figure 7:
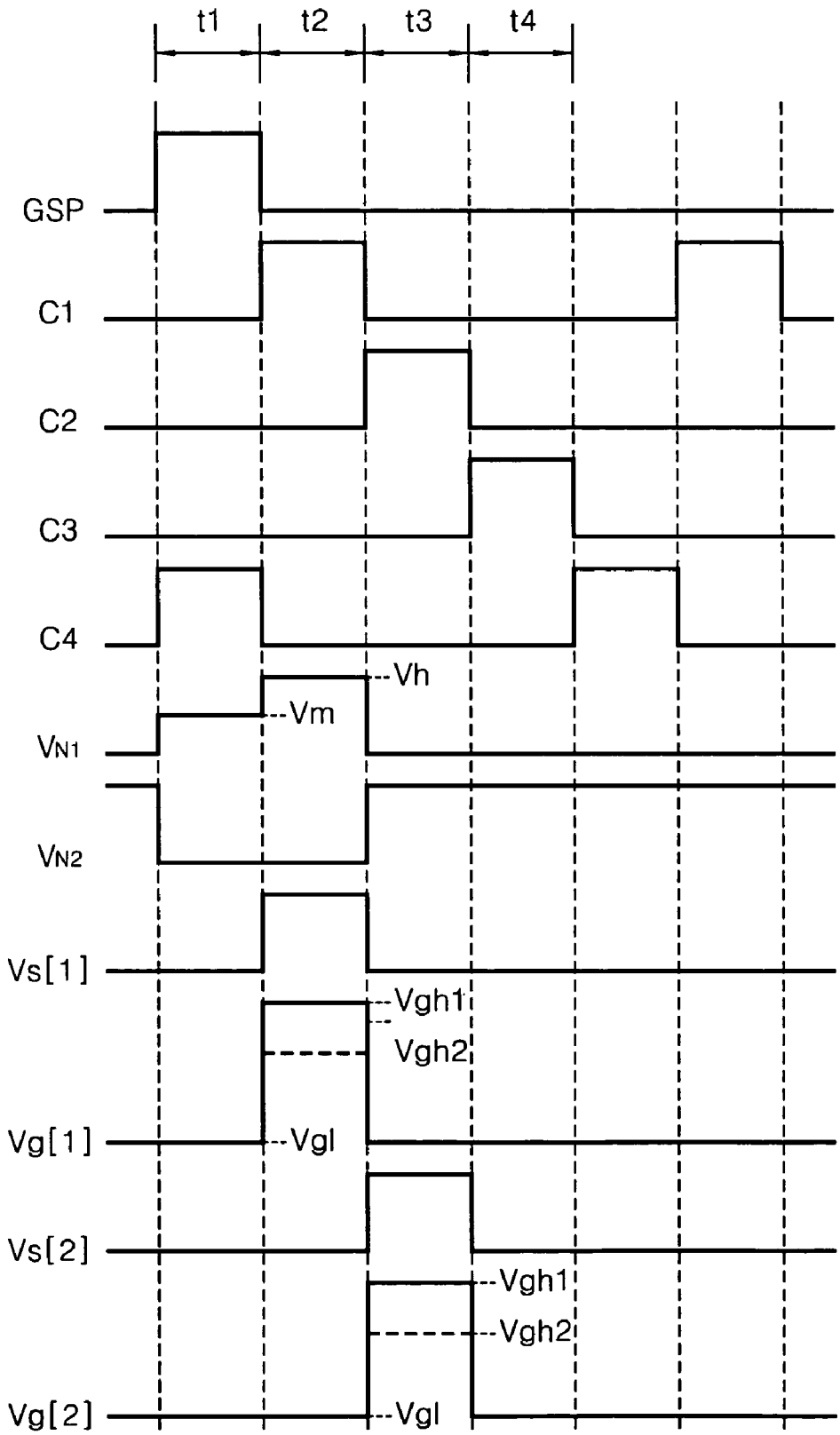
FIG. 7 is a diagram representing a drive signal waveform of a circuit shown in FIG. 6.
Figure 8A:
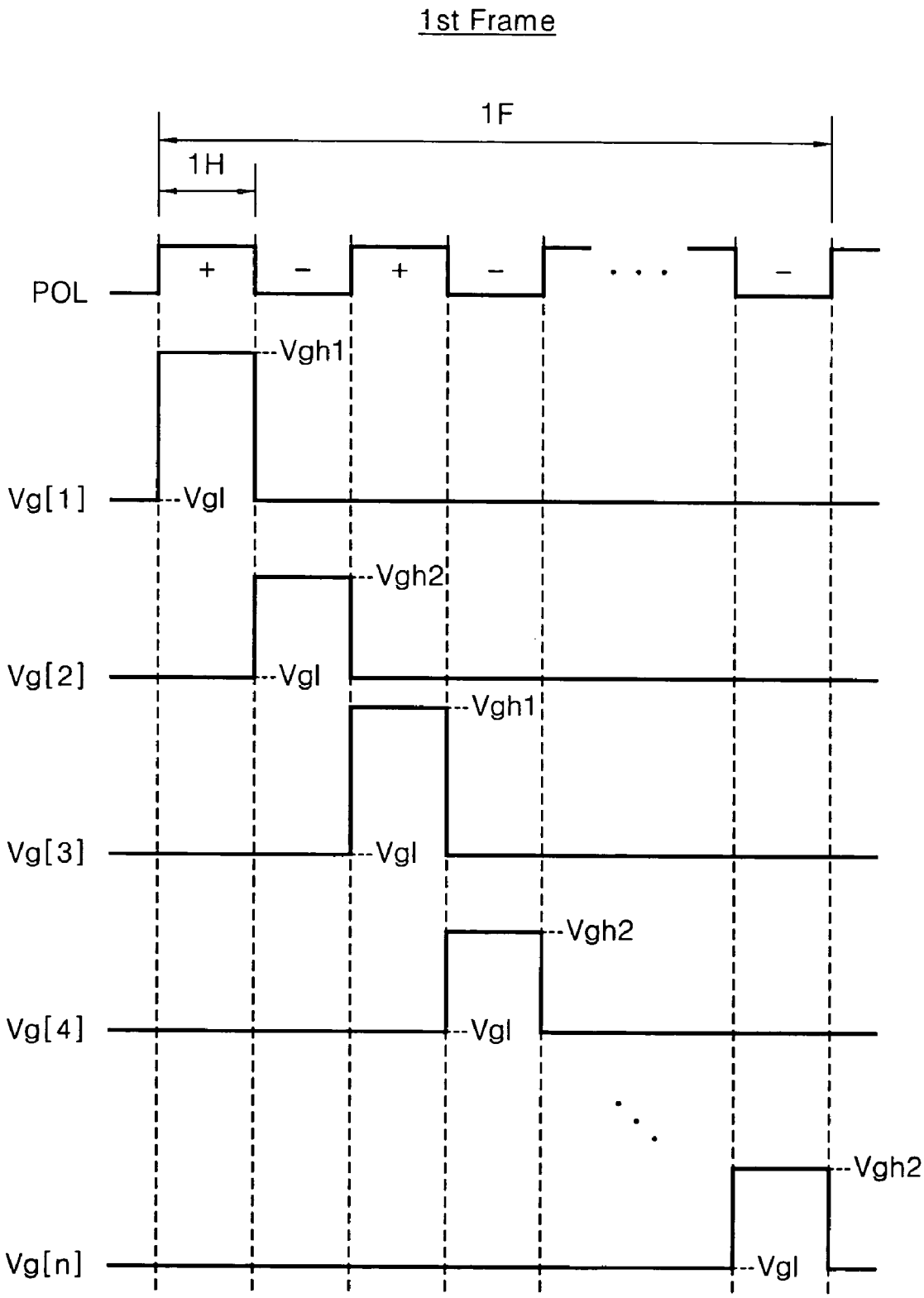
FIGS. 8A and 8B are diagrams representing a drive signal waveform upon the line inversion.
Figure 8B:
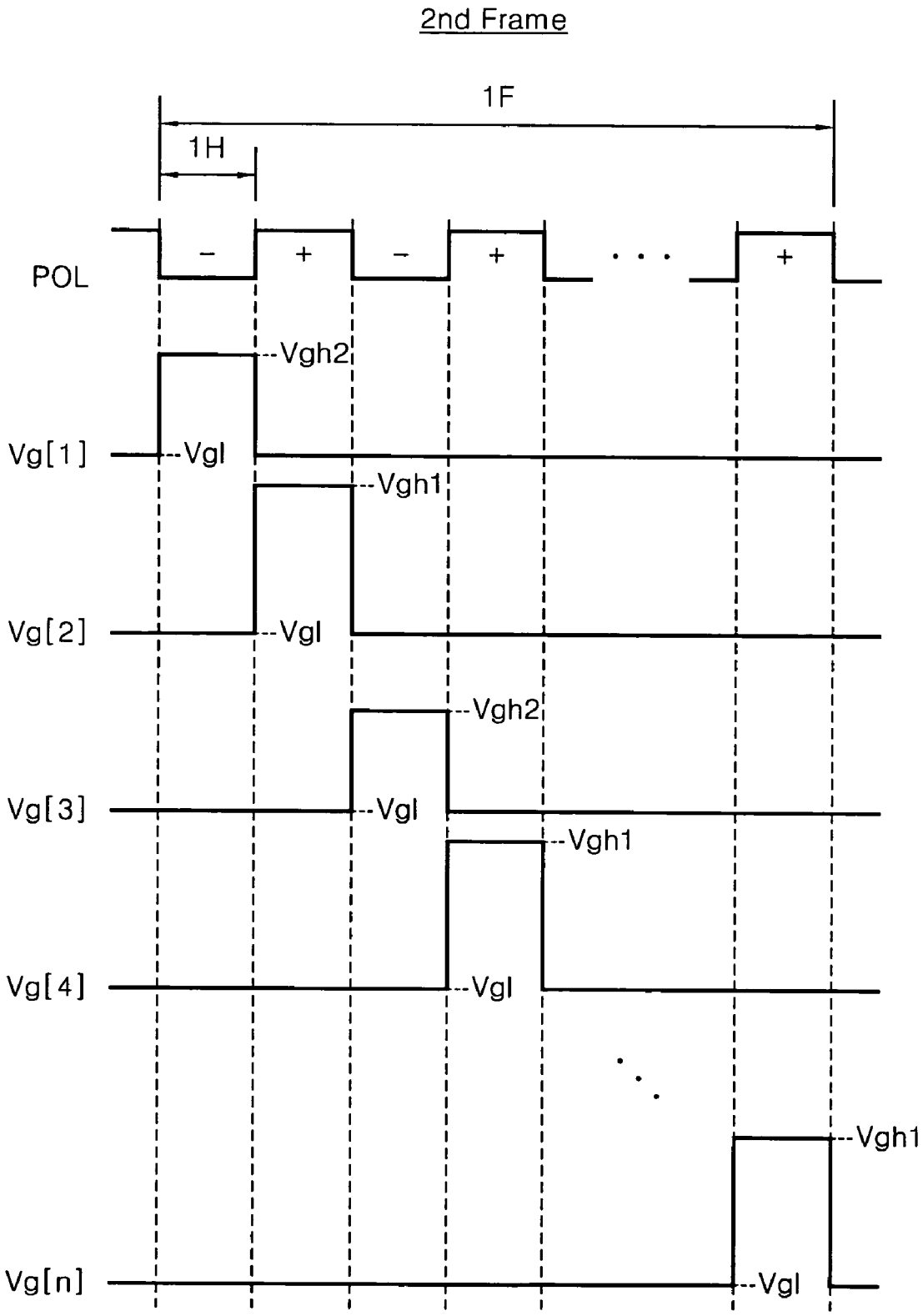

FIG. 6 illustrates a circuit configuration of the first and second level shifters LS1, LS2 and the first and second stages S1, S2 of the shift register 61 in the gate drive circuit 52 shown in FIG. 5. FIG. 7 illustrates waveforms of the drive signals. FIGS. 8A and 8B are diagrams that illustrate a drive signal waveform upon the line inversion.

The operation of the gate drive circuit 52 will be explained with reference to FIGS. 6 and 8B. In one embodiment, the second to $n^{th}$ stages S2 to Sn of the shift register 61 has the same circuit configuration as the first stage S1 except that the shift output signal Vs1 to Vs [n−1] of the pre-stage S1 to S[n−1 instead of the gate start pulse is supplied as the shift input signal, and the second to $n^{th}$ level shifter LS2 to LSn also have the same circuit configuration as the first level shifter LS1. Accordingly, the operation description will be made on the basis of the first level shifter LS1 and the first stage S1 of the shift register 61 and the description for the configuration below will be omitted.

In one embodiment, as shown in FIGS. 6 and 7, the gate start pulse GSP is supplied to the gate electrode of the first and fourth transistors T1, T4 as a high logic voltage for a t1 period which the first and second clock signals C1, C2 maintains a low logic voltage, which turns on the first and fourth transistors T1, T4. In one embodiment, for example, at this moment, a voltage $V_{N1}$ on the first node N1 is increased to an intermediate voltage Vm to turn on a fifth transistor T5, but the first clock signal C1 is kept as the low logic voltage, thus the voltage on the third node N3, i.e., the first shift output voltage Vs1 maintains the low logic voltage. The voltage $V_{N2}$ on the second node N2 is decreased by the turn-on of the fourth transistor T4 to turn off a second transistor T2 and a sixth transistor T6, which blocks a discharge path of the first and third node N1, N3.

In one embodiment, during a t2 period, the gate start pulse GSP is inverted to the low logic voltage, but the first clock signal C1 is inverted to the high logic voltage. In one embodiment, for example, at this moment, the first transistor T1 and the fourth transistor T4 are turned off and the voltage $V_{N1}$ on the first node N1 is increased to a voltage of not less than the threshold voltage of the fifth transistor T5 as the voltage charged in the parasitic capacitance between the drain electrode and the gate electrode of the fifth transistor T5 to which the high logic voltage of the first clock signal C1 is supplied is added thereto. For example, the voltage $V_{N1}$ on the first node N1 is increased to a voltage which is higher than that of the t1 period by bootstrapping. Accordingly, during a t2 period, the fifth transistor T5 is turned on and the first shift output signal Vs1 is increased by the voltage of the first clock signal C1, which is supplied by the conduction of the fifth transistor T5, to be inverted to the high logic voltage.

In one embodiment, if the shift output signal Vs1 of the first stage S1 is inverted to the high logic voltage, a seventh transistor T7 of the first level shifter LS1 is turned on and the first gate high voltage Vgh1 or the second gate high voltage Vgh2 are supplied to the first gate line GL1. The first gate high voltage Vgh1 or the second gate high voltage Vgh2 supplied to the first gate line GL1 turns on the thin film transistors TFT of which the gate electrode is connected to the first gate line GL1, thereby supplying the data voltage Vd to the liquid crystal cell Clc. The gate-on voltage supplied to the gate line GL1 is selected by the voltage selector 62 in accordance with the polarity signal POL as described above. The polarity signal POL has a different inversion cycle in accordance with the inversion method.

In the line inversion method, as shown in FIG. 4A, the polarity of the polarity signal POL is inverted for each horizontal period, and also inverted for each frame period. In one embodiment, where the connection of the thin film transistor and the gate line is made in a zigzag shape, the polarity of the data supplied to the liquid crystal cells which are adjacent vertically and horizontally is substantially inverted for each dot, as shown in FIG. 4B. For example, the voltage selector 62 selects the first gate high voltage Vgh1 or the second gate high voltage Vgh2 in accordance with the polarity signal POL of which the polarity is inverted, and the scan signals Vgl to Vgn are sequentially supplied to the gate lines GL1 to GLn, as shown in FIGS. 8A and 8B. Alternatively, the frame period is also called as a field period, and is a display period of one screen when data are applied to all the pixels of one screen. The frame period is standardized to be 1/60 seconds in case of an NTSC system and to be 1/50 seconds in case of a PAL system.

In one embodiment, during a t3 period, the first clock signal C1 is inverted to the low logic voltage and the second clock signal C2 is inverted to the high logic voltage. In one embodiment, for example, at this moment, the high potential power voltage Vdd is supplied to the second node N2 through the third transistor T3, which is turned on in response to the second clock signal C2, to increase the voltage $V_{N2}$ on the second node N2. The voltage $V_{N2}$ on the second node N2 turns on the second transistor T2 to discharge the voltage $V_{N1}$ on the first node N1 to a ground voltage Vss, and at the same time, turns on the sixth transistor T6 to discharge the voltage on the third node N3 to the ground voltage Vss.

In one embodiment, if the voltage on the third node N3 is discharged to the ground voltage Vss, i.e., the shift output signal Vs1 of the first stage S1 is inverted to the low logic voltage, then the seventh transistor T7 of the first level shifter LS1 is turned off. In one embodiment, for example, at this moment, the eighth transistor T8 of the first level shifter LS1 is turned on by the second clock signal C2 to supply the gate low voltage Vgl to the first gate line GL. The gate low voltage Vgl supplied to the first gate line GL1 turns off the thin film transistors TFT of which the gate electrode is connected to the first gate line GL1.

In one embodiment, during a t4 period, if the second clock signal C2 is inverted to the low logic voltage, the third transistor T3 is turned off. In one embodiment, for example, at this moment, the high logic voltage is floated on the second node N2. The high logic voltage floated on the second node N2 is maintained until the fourth transistor T4 is turned on by the gate start pulse GSP in the next frame period to discharge the voltage of the second node N2.

In an alternate embodiment, the shift register 61 and the level shifters LS1 to LSn in the gate drive circuit 52 shown in FIG. 5 are replaced with another shift register and level shifters, which are widely known, other than the circuit shown in FIG. 6.

In one exemplary embodiment, the liquid crystal display device sets the gate-on voltage upon the negative (−) driving lower than the gate-on voltage upon the positive (+) driving to reduce the feed-through voltage ΔVp difference between upon the positive (+) driving and upon the negative (−) driving, thereby preventing the flickers and the residual images to improve the display quality.

In another exemplary embodiment, the arrangement structure of the pixels is changed for the data to be supplied to the liquid crystal display panel according to the line inversion method. The liquid crystal display device and makes the polarity of the data which are revealed in the liquid crystal display panel substantially different for the liquid crystal cells which are adjacent horizontally and vertically. Accordingly, it is possible to improve the display quality by preventing the vertical cross talk and the residual image.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. This includes the combination of various embodiments. Accordingly, the scope of the invention shall be determined only by the appended claims and their equivalents.

What is claimed is:

1. A driving method of a liquid crystal display device, which has a plurality of data lines, a plurality of gate lines which cross the data lines, a plurality of liquid crystal cells formed in pixel areas which are defined by the crossing of the data lines and the gate lines, a plurality of first switch devices disposed between the data lines and the gate lines for driving a first liquid crystal cell, and a plurality of second switch devices for driving a second liquid crystal cell which is horizontally adjacent to the first liquid crystal cell, and where the plurality of first switch devices are connected to the (n−1) th(n is a positive integer of not less than 2) gate line and the plurality of second switch devices are connected to the n thgate line, the driving method comprising:

generating data that have the same polarity for the liquid crystal cells that are adjacent horizontally and opposite polarities for the liquid crystal cells that are adjacent vertically, supplying the data to the data lines;

generating a scan signal that has different swing widths from each other in accordance with the polarity of the data; and supplying the scan signals to the gate lines.

2. The driving method according to claim 1, wherein generating the scan signal comprises: generating a first scan signal of a first swing width corresponding to the positive data and a second scan signal of a second swing width corresponding to the negative data, wherein the second swing width is narrower than the first swing width.

* * * * *